US005968203A

United States Patent [19]

Brown

[11] Patent Number: 5,968,203

[45] Date of Patent: Oct. 19, 1999

[54] CLAY-CONTAINING TEXTILE MATERIAL TREATING COMPOSITION AND METHOD

[75] Inventor: Harold M. Brown, Lyman, S.C.

[73] Assignee: Sybron Chemicals Inc., Birmington, N.J.

[21] Appl. No.: 09/031,152

[22] Filed: Feb. 26, 1998

Related U.S. Application Data

[60] Provisional application No. 60/039,269, Feb. 28, 1997.

[51] Int. Cl.[6] ..... D06L 1/12; C11D 3/12

[52] U.S. Cl. ..... 8/139; 8/137; 510/328; 510/334; 510/531; 510/532; 510/336; 510/337; 510/403; 510/405; 510/418; 252/8.84; 252/8.91

[58] Field of Search ..... 8/137, 139; 510/328, 510/334, 531, 532, 337, 336, 403, 405, 418; 252/8.84, 8.91

[56] References Cited

U.S. PATENT DOCUMENTS

| | | | |
|---|---|---|---|
| 3,427,119 | 2/1969 | Dehnert et al. . | |
| 3,483,095 | 12/1969 | Bean . | |
| 3,574,513 | 4/1971 | Wolf et al. . | |
| 3,594,111 | 7/1971 | Witcoff et al. . | |
| 3,594,212 | 7/1971 | Ditsch . | |
| 3,597,304 | 8/1971 | Baldwin et al. . | |
| 3,619,357 | 11/1971 | Keen . | |
| 3,707,347 | 12/1972 | Mueller . | |
| 3,716,488 | 2/1973 | Kolsky et al. | 8/137 |
| 3,886,075 | 5/1975 | Bernardino . | |
| 3,989,631 | 11/1976 | Marsan . | |
| 3,993,573 | 11/1976 | Gloss . | |
| 4,032,291 | 6/1977 | Dellian . | |
| 4,055,248 | 10/1977 | Marsan . | |
| 4,059,516 | 11/1977 | Heisey . | |
| 4,073,996 | 2/1978 | Bednek et al. . | |
| 4,178,254 | 12/1979 | Leikhim et al. . | |
| 4,386,010 | 5/1983 | Hildebrandt . | |
| 4,469,605 | 9/1984 | Ramachandran et al. . | |
| 4,549,966 | 10/1985 | Beall . | |
| 4,648,945 | 3/1987 | Isenberg . | |
| 4,681,665 | 7/1987 | Guillermet et al. . | |
| 4,715,969 | 12/1987 | Rothanavibhata et al. | 510/328 |
| 4,740,488 | 4/1988 | Fogler et al. . | |
| 4,767,546 | 8/1988 | Weinstein . | |
| 4,780,105 | 10/1988 | White et al. . | |
| 4,814,095 | 3/1989 | Puchta et al. . | |
| 4,844,821 | 7/1989 | Mermelstein et al. . | |
| 4,994,089 | 2/1991 | Bartkowiak et al. . | |
| 5,130,028 | 7/1992 | Cody et al. . | |
| 5,151,155 | 9/1992 | Cody et al. . | |
| 5,169,888 | 12/1992 | Sales . | |
| 5,177,066 | 1/1993 | Shimohiro et al. . | |
| 5,290,423 | 3/1994 | Helber, Jr. et al. . | |
| 5,358,647 | 10/1994 | Puentes-Bravo et al. | 510/328 |
| 5,376,283 | 12/1994 | Hooykaas . | |
| 5,401,417 | 3/1995 | Dentel et al. . | |
| 5,454,955 | 10/1995 | Albrecht et al. . | |
| 5,500,151 | 3/1996 | Cao et al. | 510/321 |
| 5,509,940 | 4/1996 | Zbar et al. . | |
| 5,540,740 | 7/1996 | Yao et al. . | |
| 5,660,706 | 8/1997 | Zhao et al. . | |
| 5,681,441 | 10/1997 | Svendsen et al. . | |

FOREIGN PATENT DOCUMENTS

| | | |
|---|---|---|
| 2247470 | 3/1992 | United Kingdom . |

OTHER PUBLICATIONS

Fite, F.J., "Dyeing Polyester at Low temperatures: Kinetics of Dyeing with Disperse Dyes", *Textile Research Journal,* vol. 65, pp. 362–368 (1995). (Month Unknown).

*Ullman's Chemical Encyclopedia,* vol. A 26, §5.7 Dyeing Accelerants (Carriers), pp. 283–284, (1975) (Month Unknown).

*Ullman's Chemical Encyclopedia,* vol. A 7, §§ 1–7 Clays, pp. 109–136, (1994) (Month Unknown).

*Kirk–Othmer Encyclopedia of Chemistry,* vol. 6, pp. 381–423 & vol. 8, pp. 712–715 (1989) (Month Unknown).

H. van Olphen, *Clay Colloid Chemistry,* pp. 182–183 (1991) (Month Unknown).

Peters, R. H., Textile Chemistry, Chapter 22—Carrier Dyeing, pp. 723–740 (1975). (Month Unknown).

Richardson, Louis L., "Use of Bleaching Clays", *Jour. of the Amer. Oil Chemists' Soc.,* vol. 55, pp. 777–780 (1978) (Month Unknown).

Patterson, H.B.W., "Bleaching Practices in Europe", *Jour. of the Amer. Oil Chemists' Soc.,* vol. 53, pp. 339–341 (1976) (Month Unknown).

*Primary Examiner*—Alan Diamond

*Attorney, Agent, or Firm*—Akin, Gump. Strauss, Hauer & Feld, L.L.P.

[57] ABSTRACT

The present invention relates to a composition for treating synthetic textile material and a method of using it. The composition comprises a smectite clay to scour the textile material, a wetting agent to enhance addition of the clay to other components of the composition, a sequestrant to sequester metal ions that inhibit the performance of the clay, and, when the composition is an aqueous slurry, a viscosity control agent to adjust the viscosity of the composition in order to prevent separating or settling of the clay. The method comprises contacting the textile material with the synthetic textile material treating composition under conditions sufficient to remove the contaminants from the textile material and washing the textile material treating composition off of the textile material, thereby producing a treated textile material from which the contaminants have been removed.

14 Claims, No Drawings

CLAY-CONTAINING TEXTILE MATERIAL TREATING COMPOSITION AND METHOD

CROSS-REFERENCE TO RELATED APPLICATION

This application claims the benefit under 35 U.S.C. § 119(e), of U.S. Provisional patent application No. 60/039,269, filed Feb. 28, 1997.

BACKGROUND OF THE INVENTION

The present invention relates to a composition and method of treating synthetic textile material used in yarns, textiles and carpets to scour the textile material, make it more susceptible to dyeing, and/or to enhance other properties of the textile material while reducing the biochemical oxygen demand (BOD) and chemical oxygen demand (COD) in effluents resulting from the treatment. The composition comprises clay and appropriate formulation adjuvants.

Various types of clays, particularly smectite, have been used in the past for treating wastewater, for bleaching edible oils, in laundering wash and rinse cycles, and in fabric softening in automatic clothes dryers, among many other uses.

Bentonite clay has been used in combination with a wetting agent and a sequestrant for bleaching cotton. The clay adsorbs color bodies that are oily impurities on the cotton fiber.

Although there has been a long-felt need for a product that effectively scours synthetic textile material of the type used in yarns particularly suitable for carpets, as well as the carpeting material made from them, and there has been a like long-felt need for the use of such a product which does not contaminate effluent with high BOD and COD discharge levels, those familiar with the carpet dyeing and finishing industry have not found a solution to these problems. The present invention is a solution to the long-felt, but unsolved problems particularly in the carpet industry, but it also is applicable more broadly, for example to textile material used as wearing apparel and particularly spandex-containing material. Use of the composition of the present invention adsorbed and precipitated organic impurities, which reduced subsequent BOD and COD in effluents. Dyeing of the treated textile material, and especially the carpet material and yarn used for carpets, is noticeably superior compared to material treated with the current scouring products.

BRIEF SUMMARY OF THE INVENTION

One aspect of the present invention relates to a composition for treating synthetic textile material, the composition comprising a smectite clay to scour the textile material, a wetting agent to enhance addition of the clay to other components of the composition, a sequestrant to sequester metal ions that inhibit the performance of the clay, and, when the composition is an aqueous slurry, a viscosity control agent to adjust the viscosity of the composition in order to prevent separating or settling of the clay.

Another aspect of the present invention relates to a method for treating synthetic textile material containing contaminants, the method comprising contacting the textile material with the synthetic textile material treating composition of the present invention under conditions sufficient to remove the contaminants from the textile material and washing the textile material treating composition off of the textile material, thereby producing a treated textile material from which the contaminants have been removed.

DETAILED DESCRIPTION OF THE INVENTION

As mentioned above, the present invention relates to a synthetic textile material treating composition and method for using it to remove contaminants from the textile material to be treated with the composition.

As used herein, "textile material" means any fiber, filament, yarn intermediate, yarn, fabric and any product made from fabric that retains the properties of the fiber or filament used therein. Included within the term are textured and non-textured filaments and yarn and woven, knit or non-woven fabrics made therefrom. Specifically preferred products are spandex-containing fabrics and all kinds of carpeting.

As used herein, "synthetic" with respect to the term "synthetic textile material" means any textile material made from a man-made, namely, synthetic, fiber. Synthetic fibers include acetate, acrylic, modacrylic, nylon, olefin, polyester, rayon, spandex, triacetate and urethane fibers, among many other well-known synthetic fibers.

As used herein, "contaminant" means any organic or inorganic material which is an impurity in or on the textile material being treated. Typical contaminants include, but are not limited to, oils such as processing oils like silicones, butylstearate, mineral oil, etc; and the fiber finishing components such as antistatic agents, emulsifiers, antioxidants and thickening agents; and inorganic contaminants, such as dust, dirt, metals, salts, etc.

As used herein, the terms "percent", "%", "weight percent" and "wt %" all mean the percentage by weight of the indicated component or ingredient within the product or composition in which it is present, without dilution, unless otherwise indicated by the context in which the term is used.

The textile treating composition of the present invention comprises a smectite clay to scour the textile material, a wetting agent to enhance addition of the clay to other components of the composition and to wet the textile material, a sequestrant to sequester metal ions that inhibit the performance of the clay, and, when the composition is in the preferred aqueous slurry form, a viscosity control agent to adjust the viscosity of the composition to prevent clay separation or settling, typically to about 2,000 cps to about 4,000 cps.

The clay component is smectite clay having the general characteristics as described in *Kirk-Othmer Encyclopedia of Chemistry*, Third Edition, 6:391–394 (1989) and *Ullmann's Chemical Encyclopedia*, A7:116–119, 124–125, and 131–133 (1994), the disclosures of both being incorporated herein by reference. The preferred clay is a bentonite clay, and more particularly, a sodium bentonite clay in the form of a free-flowing powder or agglomerate. The presently preferred bentonite has the following characteristics: the powder has a brightness on the Hunter Color Scale of L greater than 87; a cation exchange capacity of about 75 milliequivalents per 100 g; a particle size of about 0.1$\mu$ to about 15$\mu$ (averaging about 4$\mu$) as a powder and about 0.4 mm to about 1.1 mm as an agglomerate; a moisture content of 10±2% in powder form or 12±2% in agglomerate form; a swelling volume of at least about 18 ml, based on 2 g in 100 ml water; a pH (at a 2% suspension) of about 9 to about 11; a loose bulk density of 550±50 g/l in powder form and about 830±50 g/l in agglomerate form; with a powder residue on a 45$\mu$ screen of a maximum of about 5%. The presently preferred bentonite has the following chemical analysis: $SiO_2$, about 70.0%; $Al_2O_3$, about 16.0%; MgO, about 2.7%; $Na_2O$, about 2.8%; $Fe_2O_3$, about 1.3%; $K_2O$, about 1.0%; CaO, about 1.1%; and about 5% loss on ignition.

It is believed that the clay component provides both a scouring and softening effect, in essence by adsorbing organic contaminants and acting as an ion exchanger, in effect having a contaminant-suspending capacity. The powder or agglomerate particles of the clay divide into primary crystal plates caused by the swelling of the clay. The average size of the primary crystal plates is approximately 1$\mu$. After being dispersed in the treatment liquor, the contaminants detached from the treated textile material are adsorbed by the clay particles, resulting in a greatly reduced redeposition of the contaminants. Textile incrustation is reduced due to the hardness elements released during washing having either become attached to the dispersed clay crystals or having been deactivated by the sequestrant. Clay, a natural product, washes off the treated textile material and forms an effluent having low BOD and COD values. The clay does not contribute to the BOD or COD values at all.

The composition is preferably in the form of an aqueous slurry, although the components of the composition can be subject to suitable drying processes, such as encapsulation and the like, and blended together in a dry blender. One skilled in the art could readily produce a dry or solid composition. For ease of use, the aqueous slurry is the preferred form and will be the form in which the composition will be further described herein.

The wetting agent may be any compatible wetting agent, such as a surfactant or detergent which enhances addition of the clay to other components of the composition. The wetting agent also facilitates the textile material treatment with the clay. It must be either nonionic, anionic or amphoteric, but not cationic. The presently preferred wetting agent is tridecyl alcohol 3 mole ethoxylate (TDA3), although any other compatible wetting agent can be used, such as decyl alcohol 6 mole ethoxylate(DA6), nonylphenol 9 ethoxylate (NP9) or ethoxylate dioctylsulfosuccinate (DOSS), etc.

The sequestrant may be any sequestrant capable of sequestering metal ions that adversely affect the clay and particularly the ion transfer capabilities of the clay. Metal ions may also adversely affect dyeing and other processing of the textile material being treated. Preferred sequestrants are aminopolycarboxylate (APC) sequestrants and phosphonates.

The APC sequestrant used with the present invention may have the following structural Formula (I):

(I)

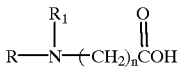

wherein $n$ is 1 or 2 and

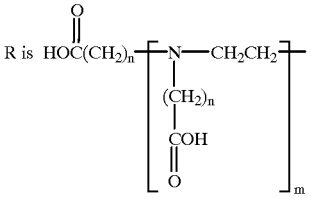

where m is 0–5; and

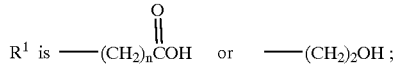

and any soluble salts thereof.

Nonlimiting examples of APC sequestrants within the scope of Formula (1) include nitrilotriacetic acid (NTA), N-hydroxyethyliminodiacetic acid (HEDA), ethylenediaminetetraacetic acid (EDTA), N-hydroxyethylethylenediaminetriacetic acid (HEEDTA), diethylenetriaminepentaacetic acid (DTPA), and diaminocyclohexanetetraacetic acid (DCTA), and soluble salts thereof. Other suitable APC sequestrants are likewise commercially available and well known to those skilled in the art.

The presently preferred APC is EDTA, or any of the soluble salts of EDTA, most conveniently, the sodium or potassium salts, and preferably, the sodium salts. Examples are EDTA disodium salt, EDTA dipotassium salt, EDTA trisodium salt, EDTA tripotassium salt, EDTA tetrapotassium salt and EDTA tetrasodium salt.

Presently, the more preferred, most economical APC products are EDTA salts, and particularly the tetrasodium salt of EDTA, available for example as PLEXENE™, extra concentrated, having a 40 wt % concentration of EDTA tetrasodium salt, marketed by Sybron Chemicals Inc.

Phosphonate sequestrants are the more preferred class of sequestrants, and, even more particularly, it is preferred to use an amino polyphosphonate, such as is available, from Monsanto Company, for example as DEQUEST® chelates, designations 2000 (aminotrimethylenephosphonic acid (ATMP)), 2006 (aminotrimethylenephosphonic acid, pentasodium salt ($Na_5$ATMP)), 2010 (hydroxyethylidene diphosphonic acid (HEDP)), 2016 (hydroxyethylidene diphosphonic acid, tetrasodium salt ($Na_4$HEDP)), 2060 (diethylenetriaminepenta(methylenephosphonic acid) (DTPMP); 2066 (diethylenetriaminepenta (methylenephosphonic acid), hexasodium salt ($Na_6$DTPMP)); among others.

The presently most preferred type of sequestrant is DTPMP in an amount sufficient to prevent adverse metal interaction with the clay or textile processing. This sequestrant is available commercially, for example in a concentration of 50 wt %, as DEQUEST® 2060, marketed by Monsanto Company.

Other known sequestrants are polyvinylpyrrolidone (PVP) and polyacrylic acids.

Since the preferred sequestrants are sold in the acid form, a neutralizing agent, such as sodium hydroxide, potassium hydroxide, or other compatible alkali should be used to neutralize the acidity of the sequestrant. Sodium hydroxide is presently more preferred because it is less expensive. If desired, preneutralized sequestering agents can be obtained readily.

The viscosity control agent may be any agent capable of adjusting the viscosity of the composition to prevent separation or settling of the clay. The composition in the form of an aqueous slurry has a preferred viscosity of about 2,000 cps to about 4,000 cps. The viscosity control agent may be a thickening agent such as starches, gums, gelatin and phycocolloids; semisynthetic cellulose derivatives, such as carboxymethylcellulose and the like; polyvinyl alcohol and carboxy-vinylates or acrylates. Anionic thickeners, in addition to preventing separation and settling of the clay, can also coat the clay, enhancing the negative charge and increasing stability of the composition.

The presently preferred viscosity control agent is a dispersible xanthan gum. The presently preferred xanthan gum is in the form of a powder and has a pH of about 5.0 to about 6.6 as a 1% solution in deionized water, has a solid content of about 84% to about 92% and has a viscosity of about 800 to about 1,200 cps as a 1% solution in deionized water as determined with a Brookfield LVF No. 3 spindle at 60 rpm.

To control the viscosity within acceptable limits for effective handling, a viscosity reducing salt, such as sodium sulfate, which shields the charges on the clay, reducing the viscosity in an aqueous bath, may be used. An effective concentration is about 1% to 8%.

The clay component is present in the aqueous slurry composition in an amount of about 20% to about 30% and preferably in an amount of about 15.6%.

The wetting agent is present in an amount of about 5% to about 15%, and preferably in an amount of about 10%.

The sequestrant is present in an amount of about 2% to about 10% and preferably in an amount of about 7.6%. Sufficient sodium hydroxide or other neutralizing agent is used to lower the pH of the sequestrant if required.

The viscosity control agent is present in an amount of about 5% to about 15%, and preferably in an amount of about 10% (as a 3% aqueous solution). On an absolute weight basis (rather than on the basis of a 3% aqueous solution), the viscosity control agent is present in an amount of about 0.15% to about 0.45%, and preferably in an amount of about 0.3%.

The preferred composition formula comprises about 15.6% of sodium bentonite clay, about 10% TDA3, about 7.6% of sequestrant (Dequest® 2060) neutralized by about 6.4% of sodium hydroxide (50% solution) or its equivalent, and about 10% of xanthan gum (3% aqueous solution), the balance being water.

The textile material treating composition of the present invention is made in a straightforward manner as follows. Water, sequestrant and any neutralizer, such as sodium hydroxide, are mixed and TDA3 is added, followed by the clay and finally by the thickener. The components are mixed until thoroughly blended.

The treatment method of the present invention comprises using the composition of the present invention to remove contaminants from synthetic textile materials. The method includes both continuous and batch processing of fibers, yarns or fabrics made from these components, and is particularly well suited to treatment of synthetic textile material in carpet form.

The first step in the treating method of the present invention is contacting the textile material with the textile material treating composition under conditions sufficient to remove contaminants from the textile material. Using the textile treating composition having the broad and preferred amounts of ingredients in the form of an aqueous slurry, the composition should be applied to the textile material at a concentration of about 0.5% to about 5%, and preferably, about 1%, based on the dry weight of the textile material. It is important that there be good flow of the composition through the textile for effective mechanical action of the clay.

Such contacting step may be performed by passing the textile material through baths containing the clay composition of the present invention, or by padding, spraying or other suitable application methods. In the carpeting industry, the use of atmospheric becks and pressure jets of the type well known to those in the industry may be used. The contacting step may be used before, during or after any of the other conventional textile treatment steps used in the processing of a particular textile for a particular purpose. For example, in the carpet industry, the contacting step using the clay composition of the present invention can be used before, during or after scouring, dyeing, printing or finishing the carpet material.

The second essential step of the method of the present invention is washing the textile treating clay composition off of the textile material to produce the treated textile material from which the contaminants have been removed. The washing step does not have any critical parameters such as temperature, duration, degree of agitation, etc., as long as the clay and its adsorbed contaminants are removed.

The effluent containing the wash has significantly reduced BOD and COD levels compared to the use of typical scouring treatment compositions and processing of textile materials. The use of the composition of the present invention eliminates or reduces the need for many of the products that ordinarily would result in effluent pollution using typical treatment products and processes. Thus, the present invention eliminates or reduces the need for other, additional or auxiliary wetting agents, chelating agents, surfactants, softeners and defoamers. As a result of the elimination or reduction of such auxiliary components, and the removal of the other contaminants from the treated textile material, primarily by adsorption by the clay component or the precipitation of contaminants resulting from the use of the present composition, the BOD and COD levels in the effluent may be reduced by as much as about 35%.

A typical continuous processing application of carpeting material using the present invention, presented by way of example, and not by way of limitation, and using the typical equipment and processing parameters used in a carpet dyehouse is as follows. First the dyes and chemical adjuncts used in dyeing are applied to the surface of the carpet or yarn in a uniform manner. The carpet or yarn then passes into a steaming chamber where steam will set the dyestuffs into the carpet fiber. Next, excess dyes and adjunct chemicals are removed by passing the material through a washing station. The carpet is subjected to a stain blocker chemical application, and is again passed through a steam chamber, another washing station and then to the dryer. At the entrance of the dryer, fluorocarbon or other optional finishing treatments are applied to the surface of the carpet material and the carpet material is then dried.

The textile treating composition of the present invention could be used at any or all of these application points that would benefit from cleaner fibers.

When atmospheric becks and pressure jets are used, the composition of the present invention could be used either in the prescouring bath or dyebaths, or both.

The effluent is readily treated by flocculating, precipitating or filtering the clay and its adsorbed and precipitated contaminants, which are removed by any well-known physical separation technique, such as filtering or the like. The resulting liquid effluent from which the solid material has been removed is significantly more environmentally acceptable than current effluents containing organic components and inorganic contaminants.

In addition to reducing pollution as a result of the lower BOD and COD levels, the use of the composition of the present invention to treat textile materials results in lower volatile organic chemicals, and has very good lubricating properties, providing a softer hand for the treated textile material. The process is non-foaming and is extremely effective at removing processing oils and excess finishing agents and other contaminants from the material. Thus, the treated textile material is cleaner, which improves dyeability and dye penetration, resulting in increased color yields of about 10% to about 30%, depending upon the materials treated and other processing parameters. The use of the composition of the present invention decreases soiling properties of the treated material and improves stain blocking and repellency. The composition of the present invention improves crock fastness and wash fastness and acts as an anti-redeposition agent so that contaminants are not reformed on the textile material after it has contacted with the clay composition of the present invention. When the clay composition is used as an additive to the dye mix, it adsorbs oils, such as dedusting oils.

The use of the clay composition of the present invention also decreases effects on dyes and processing from metals due to proper chelation to remove the metal ions.

The use of the composition of the present invention not only produces better treated textile materials, but also is more environmental-friendly than current products and processing steps used in the textile treating industry, and particularly the carpet industry.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A composition in the form of an aqueous slurry for treating synthetic textile material, the composition comprising about 20% to about 30% of a smectite clay to scour the textile material, about 5% to about 15% of a wetting agent to enhance addition of the clay to other components of the composition, about 2% to about 10% of a sequestrant to sequester metal ions that inhibit the performance of the clay and an amount of a viscosity control agent sufficient to produce a composition viscosity of about 2,000 cps to about 4,000 cps to adjust the viscosity of the composition in order to prevent separating or settling of the clay, wherein the balance of the composition is water.

2. The composition of claim 1 wherein the clay is a bentonite.

3. The composition of claim 1 wherein the wetting agent is a surfactant selected from the group consisting of a nonionic, an anionic and an amphoteric surfactant.

4. The composition of claim 1 wherein the sequestrant is selected from the group consisting of an aminopolycarboxylate and a phosphonate.

5. The composition of claim 1 wherein the clay is present in an amount of about 15.6%, the wetting agent is present in an amount of about 10%, the sequestrant is present in an amount of about 7.6%, and the viscosity control agent is present in an amount of about 0.3%.

6. The composition of claim 5, wherein the clay is bentonite, the wetting agent is tridecyl alcohol 3 mole ethoxylate, the sequestrant is diethylenetriaminepenta (methylenephosphonic acid), hexasodium salt, and the viscosity control agent is xanthan gum.

7. A method for treating synthetic textile material containing contaminants, the method comprising contacting the textile material with an aqueous synthetic textile material treating composition under conditions sufficient to remove the contaminants from the textile material, the composition comprising about 20% to about 30% of a smectite clay to scour the textile material, about 5% to about 15% of a wetting agent to enhance addition of the clay to other components of the composition, about 2% to about 10% of a sequestrant to sequester metal ions that inhibit the performance of the clay, and an amount of a viscosity control agent sufficient to produce a composition viscosity of about 2.000 cps to about 4,000 cps, to adjust the viscosity of the composition in order to prevent separating or settling of the clay, wherein the balance of the composition is water, and washing the textile material treating composition off of the textile material, thereby producing a treated textile material from which the contaminants have been removed.

8. The method of claim 7 wherein in the synthetic textile material treating composition used in the method the clay is a bentonite.

9. The method of claim 7 wherein in the synthetic textile material treating composition used in the method the clay is present in an amount of about 15.6%, the wetting agent is present in an amount of about 10%, the sequestrant is present in an amount of about 7.6%, and the viscosity control agent is present in an amount of about 0.3%.

10. The method of claim 7 wherein in the synthetic textile material treating composition used in the method the clay is bentonite, the wetting agent is tridecyl alcohol 3 mole ethoxylate, the sequestrant is diethylenetriaminepenta (methylenephosphonic acid), hexasodium salt, and the viscosity control agent is xanthan gum.

11. The method of claim 7 wherein the synthetic textile material is contacted with about 0.5% to about 5% of the synthetic textile material treating composition, the percentage of the composition being based on the dry weight of the textile material being treated.

12. The method of claim 9 wherein the synthetic textile material is contacted with about 0.5% to about 5% of the synthetic textile material treating composition, the percentage of the composition being based on the dry weight of the textile material being treated.

13. The method of claim 7 wherein the synthetic textile material is contacted with about 1% of the synthetic textile material treating composition, the percentage of the composition being based on the dry weight of the textile material being treated.

14. The method of claim 9 wherein the synthetic textile material is contacted with about 1% of the synthetic textile material treating composition, the percentage of the composition being based on the dry weight of the textile material being treated.

* * * * *